United States Patent [19]

Colp

[11] Patent Number: 4,586,298

[45] Date of Patent: May 6, 1986

[54] GUTTER GUARD

[76] Inventor: George O. Colp, 58 Fuller St., Canton, Mass. 02021

[21] Appl. No.: 616,691

[22] Filed: Jun. 4, 1984

[51] Int. Cl.[4] ..... E04D 13/06

[52] U.S. Cl. ..... 52/12

[58] Field of Search ..... 52/11-16; 405/118-121, 127; 210/153-154, 155, 162, 163, 474, 475, 498; 404/4, 5

[56] References Cited

U.S. PATENT DOCUMENTS

| | | | |
|---|---|---|---|
| 472,567 | 4/1892 | White | 210/163 |
| 803,814 | 11/1905 | Duffy | 210/163 |
| 1,195,827 | 8/1916 | Lucke | 210/163 |
| 3,445,973 | 5/1969 | Stone | 210/163 |
| 3,950,951 | 4/1976 | Zukauskas | 52/12 |
| 4,395,852 | 8/1983 | Tang | 52/12 |
| 4,447,994 | 5/1984 | Garneau | 52/11 |

FOREIGN PATENT DOCUMENTS

| | | | |
|---|---|---|---|
| 578461 | 6/1959 | Canada | 52/11 |

*Primary Examiner*—John E. Murtagh

*Attorney, Agent, or Firm*—Richard F. Benway

[57] ABSTRACT

A gutter guard which when affixed to a conventional rain gutter on a roof permits the entry of water for collection and directing the water to down spouts to protect plants and soil around a building during the spring, summer and fall, having a closable element for wintertime operation which prevents the accumulation of ice and snow in the gutter which ultimately builds up creating a dam of snow and ice forcing water under the shingles causing injury to the building and the contents therein.

8 Claims, 12 Drawing Figures

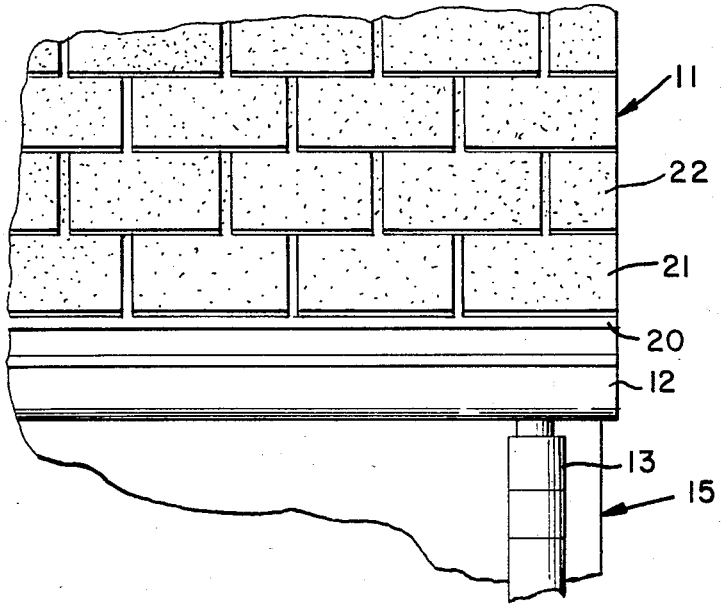
FIG. 1
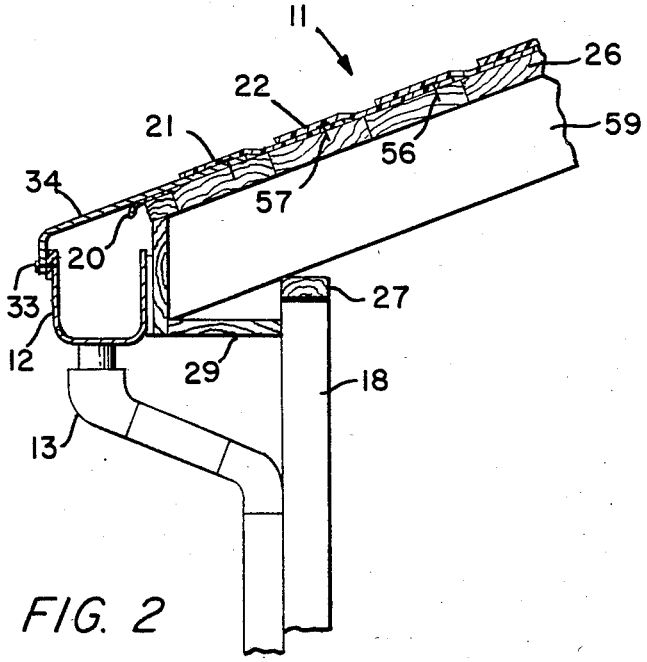
FIG. 2
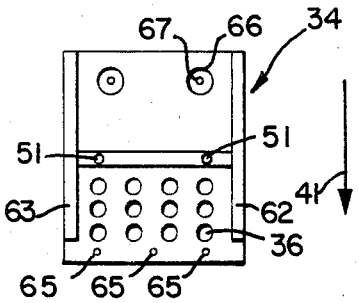
FIG 3
FIG. 4
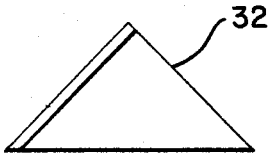

GUTTER GUARD

Rain gutters are put around the perimeter, or edge of the roof of buildings to collect water as it rolls off the roof. The idea is to prevent the water from having impact on the ground just below the edge of the roof, causing it to be dug up and accumulating, such that the individual's house will be damaged, around the foundation. Gutters have been used for a considerable period of time.

In the wintertime in northern regions, however, the ground becomes frozen and precipitation occurs in the form of snow which does not strike the ground with sufficient force to cause any damage. In the wintertime a gutter is not needed, in fact, some arrangement preventing snow and ice from accumulating in the gutter and permitting it to fall directly to the ground is desirable. Moreover, it has been discovered, particularily during these past severe winters, that the gutter which receives snow, melts from the sun, and turns into ice; eventually, the entire gutter is filled with ice and gradually builds up to the first two or three courses of shingles. When there is some melting the water encounters an ice dam and therefore soaks under the first two or three courses of shingles and enters the building causing damage to the rafters, ceilings and the buildings' contents. During the wintertime, therefore, electrical heaters have been installed along the edge of the gutters, which are turned on during the wintertime, in order to melt the ice. The present inventor has discovered a much more effective way of eliminating this problem. The present invention proposes that the gutter be entirely covered during the winter season. When the snow falls on the roof, it merely slides off as if there were no gutter there at all. No water therefore enters the gutter and it cannot build up, turn into ice and cause the damage currently being experienced in homes in the Northern area of the country.

Today's gutters are largely fabricated from wood or aluminum. The drip edge of roofs is usually a strip of aluminum which is nailed to the edge of the roof, before the first course of shingles is placed on the roof. On new instrallations the present invention obviates the need for the drip edge, and will be installed above an aluminum or wooden gutter before the roof shingles are put on. It can be installed over any metal or wooden gutter currently available. The invention will be sold in selected lengths with pieces of aluminum to cover inside corners, outside corners or odd lengths. A selected length of this product slides up under the first course of shingles and is affixed to the outer edge of the gutter, whether it be alum1num or wooden. The invention, therefore, is a very inexpensive do-it-yourself product. Drip edges which are currently used on new roofs can be eliminated, thereby reducing the cost of an installation of this invention on new roofs.

During the summertime, debris and other material accumulate in gutters. Toward fall, the accumulation of leaves becomes very difficult to cope with and the gutter downspout quite frequently plugs up and the water rushes over the edge of the gutter causing damage to the building, staining the exterior and defeating the purpose for which it was installed. With the present invention, a perforated cover extends over the entire gutter system. Leaves and other debris are unable to enter. Accordingly, the problem of stopped-up downspouts is also eliminated.

Therefore, an object of the present invention is to provide a gutter cover which can be closed completely in the wintertime.

Another object of the present invention is to provide a gutter cover closable in cold weather and openable in warm weather, which prevents the accumulation of snow and ice.

Another object of the present invention is to provide a gutter cover which eliminates the need for drip edges when used on new roof installations.

Other features and advantages of the present invention will be better understood from the attached drawing of which:

FIG. 1 is a view of a building with a gutter.

FIG. 2 is a sectional view of the building in FIG. 1 with the gutter and a gutter guard.

FIG. 3 is a top view of a section of the gutter guard.

FIG. 4 is a view of a piece of aluminum cut to cover an outside corner.

Figure 5:
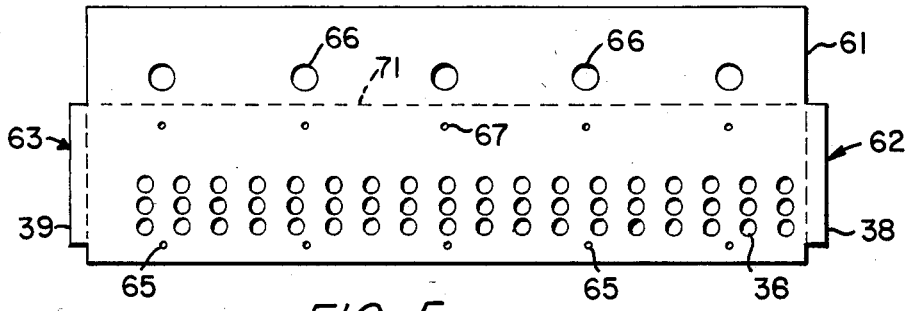
FIG. 5 is a stamped-out section of the gutter guard.

Referring now to FIG. 1, we see a building 15 with a downspout 13 from a gutter 12. The rain runs off roof 11 over the shingles 22 and 21, and to the edge of the drip edge 20 into the gutter. During the summertime, the water runs down through the downspout without any difficulty. From time to time, however, during the winter, the water in the downspout 13 freezes. Gradually snow and water in the downspout, when the weather changes, freezes solid. Eventually, a dam developes in the gutter 12, such that water running off the roof, when the snow melts by virtue of the sun, soaks under the shingles 21 and 22, and enters the building causing damage.

Referring now to FIG. 2, we see a sectional view of the roof and gutter with gutter guard in place. We first see the gutter 12 and downspout 13. The water runs in the valley down the downspout. The water, instead of going over the drip edge and into the gutter which is now covered by a gutter guard 34, goes through the openings (to be shown later in detail). A section 34 slides under the shingle 21 just as the drip edge did. It is then fastened by way of screws 33 to the gutter.

An occasional screw is desirable to make certain that the wind does not pick it up and blow it off. The weight of the shingles 22 and 21 keep the gutter guard down in place, especially the edge they rest on, without any trouble whatsoever; however, it can be nailed down through holes in the gutter guard for that purpose. Now, of course, the water running off of the roof 11 would merely go over the roof edge until it came to an opening in the gutter guard and would then drop into the gutter and down the downspout.

Referring now to FIG. 3, we see a top view of the gutter guard 34 in greater detail. The arrow shows the down direction of the gutter guard. The gutter guard has holes 36 in its bottom section, and the rain running off of the roof would enter these holes and go into the gutter and disappear down the downspout. However, a portion of the gutter guard which sticks up under the shingles also forms a pocket wherein a solid piece of aluminum slides up into it. In the winter, this shutter or piece of aluminum closes, covering all of the holes such that the water (now snow and ice) runs down and over the edge of the gutter and onto the ground below.

Therefore, during the summertime, the shutter or piece of aluminum is kept open and the water runs off of the roof and into the holes and down the downspout. This occurs in the springtime; but in late fall when the weather starts to get very cold and snow starts to fall, the gutter guard has its shutter closed. The homeowner inserts a screw or nail or some other device into the hole 51 and pulls the shutter closed. The snow and ice therefore will not go into the gutter at all, it will fall onto the ground below and when the weather gets warm again, the user would merely get a ladder and open the shutter up again so that the water can go through the holes and into the gutter below until such time as it reached the downspout.

Referring now to FIG. 5, we see a sheet of aluminum that at the factory would have been stamped out. The stamping of a section of aluminum would be to accomodate a full section of the gutter guard and they would be in various lengths. A piece would have sections 63 and 62 at either end. The section 61 would have holes of a fairly large size 66 stamped into it; and below it in the main body of the gutter guard, it would have smaller holes 67 stamped in such that when the section 61 is folded over to form a pocket along the dotted line 71, the holes 66 and 67 would be aligned such that a nail or screw could be put through the large hole 66 and through the smaller hole 67. It would then be nailed to the roof or screwed into the roof to make it solid and secure when installed. You also see an array of holes 36 that have been stamped throughtout the piece. This is to permit the water to go down into the gutter and eventually out the downspout when the gutter guard is installed in place. You also see and array of holes 65 which have been installed in it to permit sheet metal screws to be put through the openings and into the gutter to form an integral part of the entire system and hold the gutter guard in place against wind and other problems.

Figure 6:
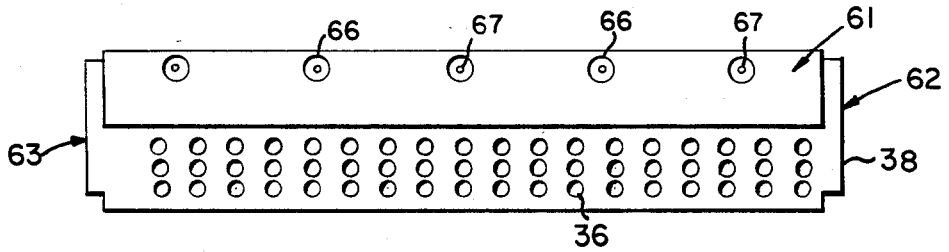
FIG. 6 is the stamped-out section of FIG. 5 with its upper portion folded to form a pocket.

Referring now to FIG. 6, we see the top section folded along the dotted line 71 and we now see it as ready to receive another section of the gutter guard 72 which forms the shutter or closing section. It is folded over in such a way that a space exists between the two pieces of aluminum, thereby forming a pocket. Folding along line 71 is such that it does not permit the two sections to be tightly pressed together, but rather loosely pressed together such that a pocket is formed between the two and will permit a piece of metal 72 to slide between the two pieces of metal.

Figure 7:
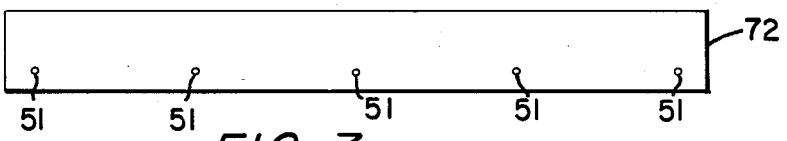
FIG. 7 is a section movable within the pocket of FIG. 6.

Referring now to FIG. 7, we see a solid piece of aluminum that will ultimately form a shutter and that is insertable into the pocket formed between the section 61 and the rest of the stamped-out piece shown in FIGS. 5 and 6. We note holes 51 which can have tabs affixed to it that permit the user to push the shutter up into the pocket or pull it out of the pocket.

Figure 8:
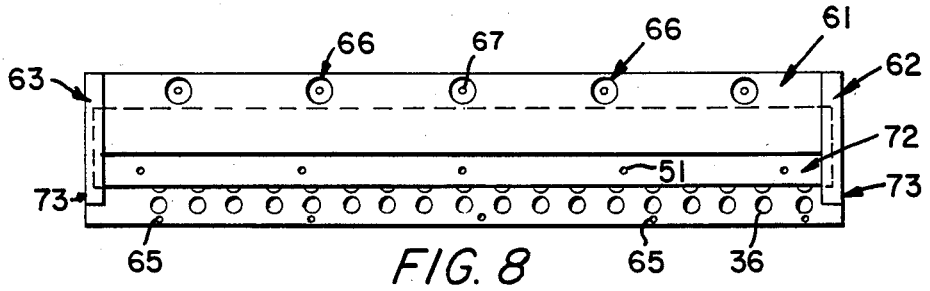
FIG. 8 is the completely fabricated section of the guard formed by the pieces shown in FIGS. 5 and 7 ready for use.

Referring now to FIG. 8, we see the two segments of the gutter guard shown in FIGS. 6 and 7 assembled together. It is to be noted that the holes of 36 are partially covered by means of the shutter 72 which has been installed in the pocket formed by the folded piece of aluminum. When the pocket and shutter 72 are put together, then the tabs 63 and 62 are folded over in such a way that they complete the unit and the pocket now is totally formed. The shutter 72 is free to move up and down in it; however, at the edge 73 which is crimped a little tighter, the shutter is not free to slip out after it is assembled and will remain in the gutter guard permanently.

It is seen that FIG. 8 is then placed on the roof, it is slid up under the shingles and sheet metal screws can be put through the hole 66 and its underneath hole 67 to be screwed to the roof or nailed to the roof as the case may need be. These are optional, of course. The holes 65 however, do permit sheet metal screws to be placed through the gutter guard and affixed to the gutter which is underneath, whether it is aluminum or wood. The owner may take the shutter 72 and open it or close it by means of pushing on the unit by means of the hole 51, which would receive a screw driver or even a nail or other sharp object and it could be pushed or pulled as the case need be.

It is contemplated that these gutter guards will be produced in sections of arbitrary lengths of approximately 1 ½feet. It is quite apparent that this type of gutter guard can be made of other metals besides aluminum. Aluminum has obvious advantages in expense, weight and characteristics which prevent rot. Corner pieces (either inside or outside) could be made of an ordinary piece of sheet metal of the same material used in fabricating the gutter guard. In FIG. 4, a triangular piece is shown as 32. It is merely a triangular piece of metal that would fit an outside corner or an inside corner to prevent water from flowing into the gutter. These could be suitably fastened by sheet metal screws to odd sections of gutter when installed. Odd sections of gutter, especially at the ends, could also be covered with straight metal sheets to prevent water from going into the gutter where not covered by gutter guards.

Referring now again to FIG. 2, we see that without the gutter guard, the water could soak up under shingles 22 and 21 and would arrive at the nails 56 and 57 and run into the building soaking the rafters 59 and the studs 27 and 28. It would also affect the plaster board which is usually nailed to the rafters and studs. It is also quite apparent that even if the water only migrated into the wood of facia board 29, it could cause rotting or would refreeze and push out the studs. A point of economy here is the fact that drip edge 20 is no longer needed on new construction and the amount of money that one would save on drip edges could be applied to the gutter guard, thereby saving considerable amounts of money.

It is to be noted then that the openings 36 are small and will prevent any large sticks, leaves or pine needles from entering the gutter. This permits leaves to dry on the openings 36 which the wind will then blow off, whereby no plugging of the gutter will be experienced. If, in fact, some unwanted materials do get into the gutter, they will run to the downspout and the removal of the downspout will permit one to remove any dirt that might have accumulated. The gutter guard is, of course, removable very easily by the removal of a screw and lifting it to clean out the gutter, if and when it is ever required. With the gutter guard, it is unlikely that anything would get into the gutter which could plug it up and it would be years before the need would arise to remove the gutter guard.

Figure 9:
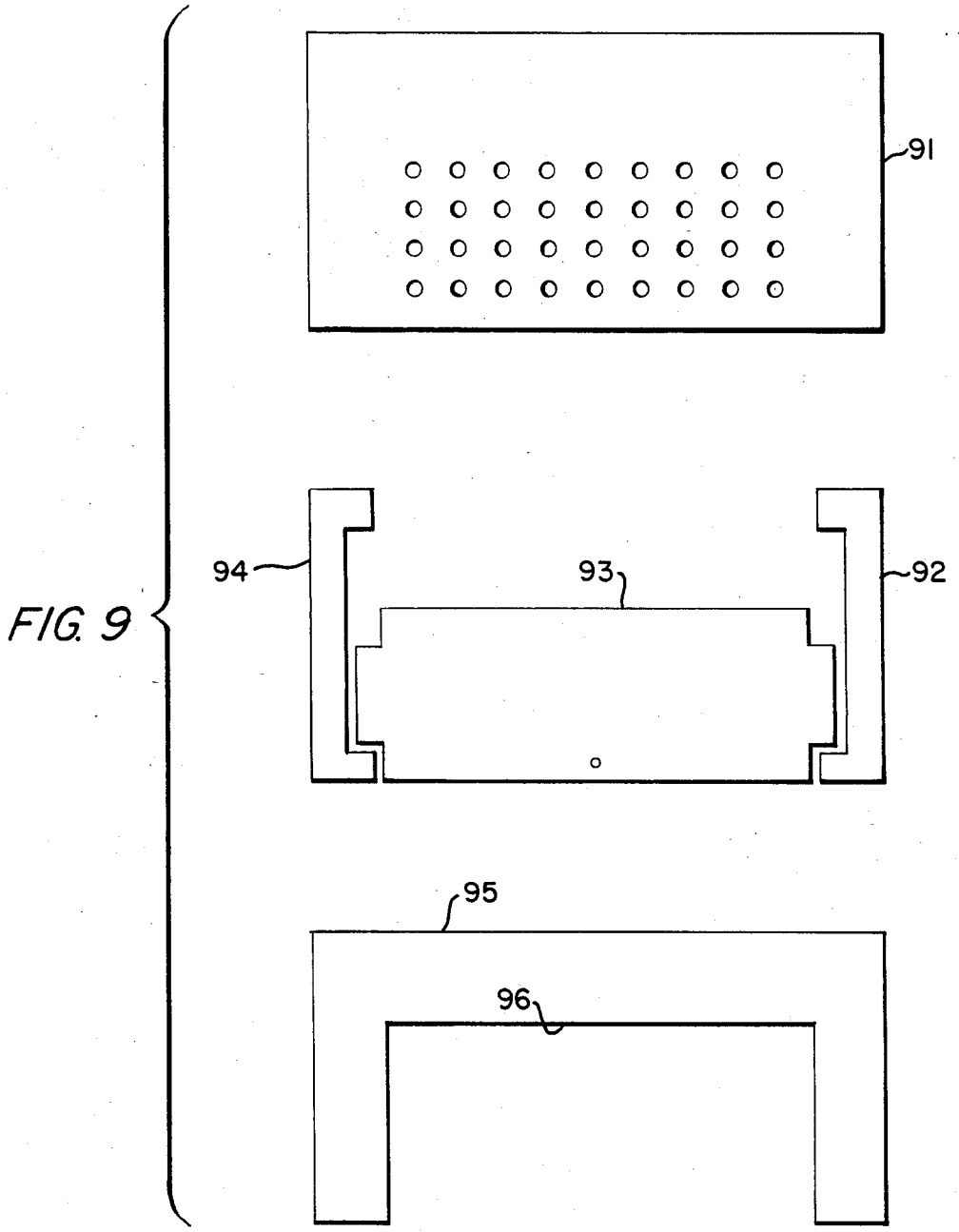
FIG. 9 is a view of the components of a vinyl unit.

Referring now to FIG. 9, we see several pieces of vinyl that have been stamped out. 91 is a basic sheet. 92 and 94 are identical pieces which will be placed on the bottom sheet 91 as will be discussed in more detail. 93 is a shutter that slides in and out of a pocket to be formed. It covers the holes as described above when the gutter guard is guarding the flow of water. When not used, 93 is slid up out of the way so the water will run down the holes and into the gutter. The top section 95 has a front 96 cut out of it and will be placed on top. The unit, that is when all the pieces are assembled together and thermally welded, will form the main component of a plastic gutter guard system for covering a gutter as described in the other (metal) example. Special welders (vinyl is a thermal setting plastic) fuse the plastic pieces together at the factory.

91 is placed down on a flat surface and 94 and 93 are placed on top of it as shown. 93 is laid in place loosely. 92 and 94 are welded to 91 which provides a pocket in which 93 is free to move. Sheet 95 is placed on top and the edges welded to the strips 92 and 94 to form a complete unit in which 93 can move without falling out.

Figure 10:
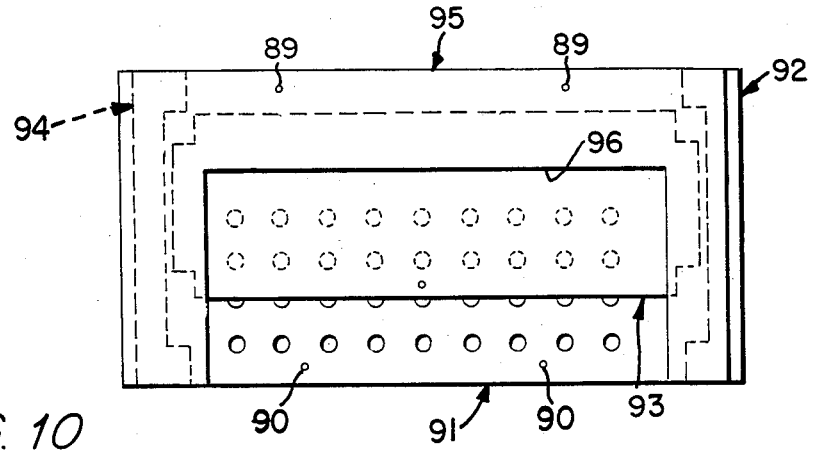
FIG. 10 is an assembled vinyl unit.

Looking now at FIG. 10, we see all of the pieces assembled together and we note that 92 projects out of the assembled pieces while 94 is recessed. This permits the units to be tongue-and-grooved. One unit has its tongue fit into the groove of the next unit, and so forth, as the pieces are installed on the roof over a gutter. It is seen 93 is free to move in this pocket in the opening at 96, thereby opening or closing the holes controlling the rain-flow into the gutter. The base 91 forms the basic structure on which all of the pieces are assembled and welded to, in order to complete the unit.

Noting that separate units are tongue-and grooved, one needs to make a blank to finish off a corner or an end of a gutter when these units were were assembled to form a complete system for covering a gutter. A blank is formed by welding together three sheets 91 without holes. Offsetting the middle sheet will form the needed tongue-and-groove. This blank unit could be cut along any side and not fall apart. It could be cut on a 45° angle, or at any other angle to fit an inside or an outside corner and the tongue-and-groove of each of the units would fit together and form a complete unit at the ends.

Figure 11:
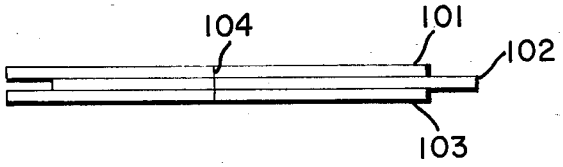
FIG. 11 is a side view of a vinyl unit.
Figure 12:
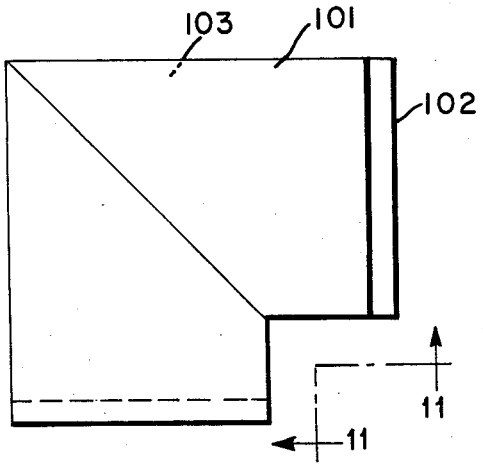
FIG. 12 is a blank cover in an inside corner.

Referring now to FIG. 11, we see an end view of a blank piece that we mentioned above. Actually, a top view or bottom view would look the same. The three layers 101, 102 and 103 are all welded together, but the inner layer is offset such that 102 is a tongue and 103 is a groove. A cut 104 is shown started on the edge of FIG. 11. If we refer to FIG. 12, we see that cut forming a 45° angle. Two pieces would fit together to form an inside corner. They could also be cut another way and an outside corner would be formed. They could be cut straight across at any point 104. The gutter guard will end with a single blank piece placed at either end of the roof.

A blank unit can be flipped over and cut at the other end and form the end at another place on the roof at the right-hand side or the left-hand side of the completely formed gutter guard. It is seen then that this unit can be supplied with movable pieces and with a few blank pieces that will be used for inside corners, outside corners, or ends in order to complete the covering of a gutter.

The units can come in about 18"lengths. They would be affixed to the roof by means of little holes drilled in each unit and nailed to the roof or held in place by the shingles placed over it. The weight of the shingles holds it firmly in place with a couple of screws along the gutter edge. The holes in this case 90 and 89 can be nailed to hold the unit in place when forming the gutter guard assembly. It is to be noted that it is optional to add the screws at 89 because the pressure or weight of the shingles that lays over it at that edge does not need any additional support. In the field, however, for a tight system 89 can be used.

It is also to be noted at 104 where two units are butted together in an inside (or even an outside) corner, a little seal, usually silicone, can be placed along the seam which will hold the two units tightly together just as the tongue-and-grooves do in the other units. Again, this is not necessary; however, to really make a tight system such that water cannot get into the gutter during the cold weather, the seam should be sealed with silicone. If a small quantity of water does seep into the gutter, the sun will come out and melt it and it will disappear. Very little water will ever seep through these units, especially if they are tongue-and-grooved.

The device is very inexpensive, but it must be closed each winter and opened each spring. It is the same in function as its counterpart, self-storing storm windows. A do-it-yourselfer, of course, would find this device very desirable for it would protect his home. The rash of increases in insurance payments to homeowners and the subsequent increase in premiums have made this invention extremely important in the northern regions of the country where large amounts of snow tend to fall. The gutter guard will reduce insurance premiums for homeowner policies.

Although I have described my invention with reference to specific apparatus, I do not wish to be limited thereby, I only wish to be limited by the appended claims.

I claim:

1. A gutter cover comprising in combination with a rain gutter mounted on a building having a shingled roof, a first plane surface of sufficient width to extend up under the first course of shingles on the building to the outer edge of the rain gutter affixed said building, a second plane surface forming a pocket with said first plane surface under said first course of shingles to receive a shutter, said first plane surface having preselected openings along the edge whereby water will enter the gutter while leaves and other debris will be excluded, shutter means for covering said openings during severe weather, which shutter slides up into said pocket and is storeable in said pocket during mild weather whereby rain water enters the gutter freely through said openings in the warm weather, and means for affixing said cover to said gutter.

2. A gutter cover according to claim 1 wherein said gutter covers come in assorted lengths for ease in installation for any gutter length.

3. A gutter cover according to claim 2 which further includes inside and outside corners to complete a building installation.

4. A gutter cover according to claim 3 wherein three solid plane surface pieces are welded together offset, thereby forming a blank unit which can be cut to form a roof end, either right or left, an inside corner or an outside corner.

5. A gutter cover according to claim 4 wherein said plane surfaces are a plastic material.

6. A gutter cover according to claim 4 wherein said plane surfaces are metal.

7. A gutter system comprising the steps of:

selecting a rain gutter affixed to a building, covering said gutter with tongue-and-grooved vinyl pieces of pre-selected lengths having shutters for controlling the flow of rain into the gutter, finishing the inside and outside corners and ends of said cover with cut-to-size blank pieces, whereby the gutter is completely covered.

8. A gutter cover according to claim 5 wherein said plastic material is vinyl.

* * * * *